US006976324B2

(12) United States Patent
Theurer et al.

(10) Patent No.: US 6,976,324 B2
(45) Date of Patent: Dec. 20, 2005

(54) METHOD OF SCANNING A TRACK BED PROFILE

(75) Inventors: Josef Theurer, Vienna (AT); Bernhard Lichtberger, Linz (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 67 days.

(21) Appl. No.: 10/683,793

(22) Filed: Oct. 10, 2003

(65) Prior Publication Data

US 2004/0088891 A1 May 13, 2004

(30) Foreign Application Priority Data

Nov. 20, 2002 (AT) ..... 767/2002 U

(51) Int. Cl.[7] ..... E02F 5/22
(52) U.S. Cl. ..... 37/105; 171/16; 104/7.3; 701/28
(58) Field of Search ..... 37/105, 104, 195; 171/16; 104/7.3, 5; 701/50, 19, 28; 172/2, 172/4.5, 1

(56) References Cited

U.S. PATENT DOCUMENTS 4,064,807 A * 12/1977 Theurer ..... 104/7.3
4,497,256 A * 2/1985 Hansmann et al. ..... 104/11
4,986,189 A * 1/1991 Theurer et al. ..... 104/12
5,094,018 A * 3/1992 Theurer et al. ..... 37/104
5,284,097 A * 2/1994 Peppin et al. ..... 104/88.02
5,301,548 A * 4/1994 Theurer ..... 73/146
5,481,982 A * 1/1996 Theurer et al. ..... 104/7.2
5,605,099 A * 2/1997 Sroka et al. ..... 104/2
6,058,628 A 5/2000 Theurer et al.
6,154,973 A * 12/2000 Theurer et al. ..... 33/651
6,681,160 B2 * 1/2004 Bidaud ..... 701/19
6,804,621 B1 * 10/2004 Pedanckar ..... 702/94

OTHER PUBLICATIONS

Rail Engineering International 2000/3, p. 16.

* cited by examiner

*Primary Examiner*—Victor Batson
(74) *Attorney, Agent, or Firm*—Collard &Roe, P.C.

(57) ABSTRACT

A method for the contactless scanning of a track bed profile extending perpendicularly to a longitudinal extension of the track, comprises the steps of simultaneously effectuating the scanning and a measurement of any deviation from a desired track level at a location of the scanning, recording the scanned track bed profile, and calculating an amount of ballast required for raising the track to the desired track level and for uniformly distributing the ballast in the track bed in dependence on the measured track level deviation and the recorded scanned track bed profile.

3 Claims, 1 Drawing Sheet

METHOD OF SCANNING A TRACK BED PROFILE

BACKGROUND OF THE INVENTION

1. Field of the Invention

The present invention relates to a method for the contactless scanning of a track bed profile extending perpendicularly to a longitudinal extension of the track.

2. Description of the Prior Art

U.S. Pat. No. 6,058,628 discloses a system for distributing ballast in a track bed, wherein a track bed profile extending perpendicularly to a longitudinal direction of a track is recorded in connection with the operation of a ballast plow. This enables excessive amounts of ballast to be located and, if desired, to use this ballast for track bed sections lacking in ballast after the excessive ballast has been temporarily stored.

According to an article in "Rail Engineering International" 2000/3, page 16, EM-SAT 120 track survey car offers fully mechanized measurement of the actual track geometry so that the calculated measurement values may be electronically transmitted to a ballast tamping machine.

SUMMARY OF THE INVENTION

It is the primary object of this invention to provide a method for the contactless scanning of a track bed profile extending perpendicularly to a longitudinal extension of the track, which provides an improved ballast distribution in the track bed.

The above and other objects are accomplished according to the invention by the steps of simultaneously effectuating the scanning of the track bed profile and a measurement of any deviation from a desired track level at a location of the scanning, recording the scanned track bed profile, and calculating an amount of ballast required for raising the track to the desired track level and for uniformly distributing the ballast in the track bed in dependence on the measured track level deviation and the recorded scanned track bed profile.

By combining the scanning of the track bed profile with the determination of any deviation from the desired track level at the location of the scanning, the ballast distribution may take into account increased ballast requirements at locations where the deviation from the desired track level is greater. In this way, the measurement of deviations from the desired track level may advantageously be used for arriving at the amount of ballast required for a uniform distribution of the ballast needed for the desired track level.

BRIEF DESCRIPTION OF THE DRAWING

The above and other objects, advantages and features of the present invention will become more apparent from the following detailed description of a now preferred embodiment thereof, taken in conjunction with the accompanying drawing wherein.

DETAILED DESCRIPTION OF A PREFERRED EMBODIMENT

Figure 1:
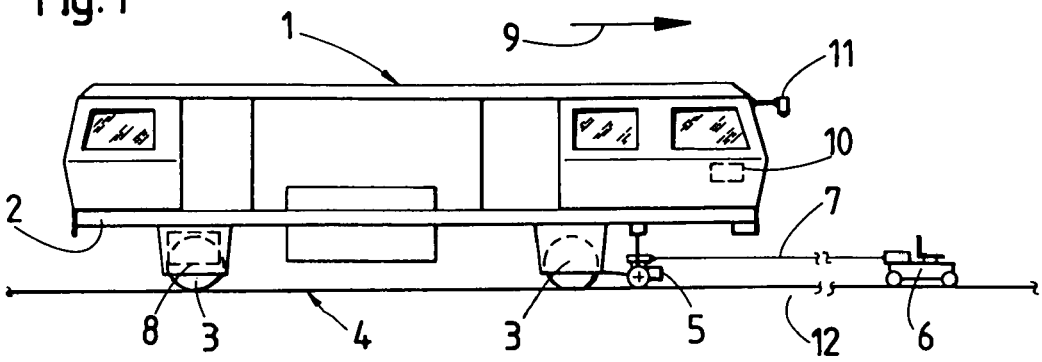
FIG. 1 is a side elevation view of an electronic track survey car.

Referring now to the drawing and first to FIG. 1, there is shown track survey car 1 comprising machine frame 2 supported on undercarriages 3 running on track 4. The track position may be measured in a known manner with a laser beam transmitter 5 mounted on machine frame 2 and a self-propelled satellite car 6 proceeding track survey car 1 and carrying a laser beam receiver to produce laser beam reference line 7. Laser scanner 11 is mounted on track survey car 1 about 3 to 4 meters above track 4. Drive 8 moves track survey car 1 in an operating direction indicated by arrow 9. Computer 10 is mounted in an operating cab of car 1.

Figure 3:
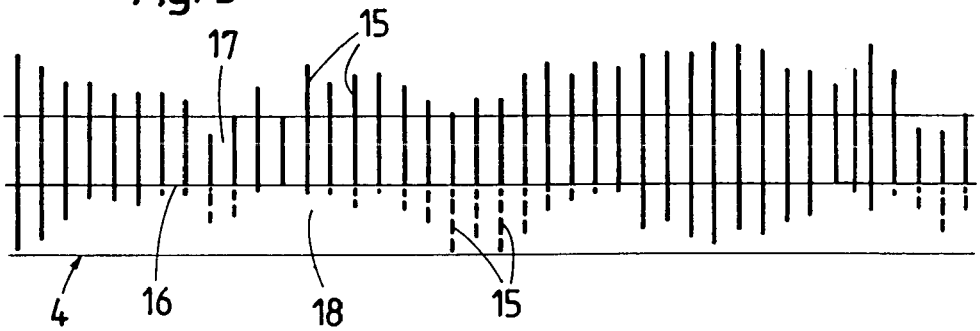
FIG. 3 is a graphic illustration of the ballast requirement for each half of the track bed.
Figure 4:
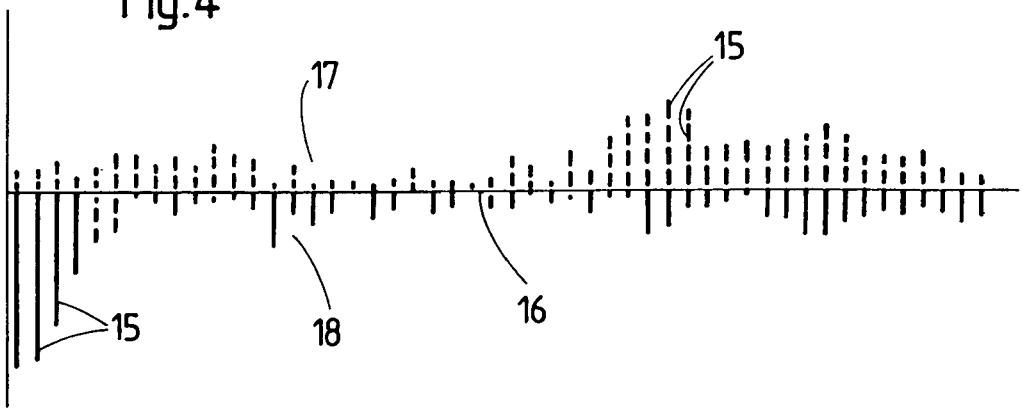
FIG. 4 is a ballast volume diagram for a given track section.

In the beginning of the contactless scanning of track bed profile 13 extending perpendicularly to a longitudinal extension of track 4 (see also FIG. 2), track survey car 1 is placed at a track section to be scanned and measured, with satellite car 6 arranged in front of it at a distance measured in relation to a fixed point. Track survey car 1 is then moved in operating direction 9 and the track level is measured and recorded for later use in a ballast tamping machine. Simultaneously with the measurement or determination of any deviation from a desired track level 14 at the location of the scanning, the scanning of track bed profile 13 is effectuated with laser scanner 11 with an angle resolution of 0.25° in an angle range of ±50° perpendicularly to the longitudinal direction of track 4 to measure the distances from track bed 12. Based on the measured data, computer 10 records scanned track bed profile 13 and displays it in a color display. Desired transverse track bed profile (track level) 14 is blended into the recorded scanned track bed profile, the volume between the scanned track bed profile and the desired track bed profile is calculated, and shown by bar diagram 15 (FIGS. 3 and 4). This volume determines the amount of ballast required for raising track 4 to desired track level 14 and for uniformly distributing the ballast in track bed 12 in dependence on the measured track level deviation and the recorded scanned track bed profile.

In this calculation, any deviation a from the desired track level is taken into account in such a manner that greater deviations from the desired track level require larger amounts of ballast because, in the subsequent tamping operation, the track must be lifted higher and therefore requires more ballast to support it. In other words, desired track bed profile 14 is calculated to be raised relative to scanned track bed profile 13 by deviation a from the desired track level, deviation a automatically determining the volume calculation. Particularly when dealing with substantial track position deviations over longer track sections, this results in a uniform distribution of the ballast and a sufficient and optimal ballast support of a track whose position has been corrected.

Figure 2:
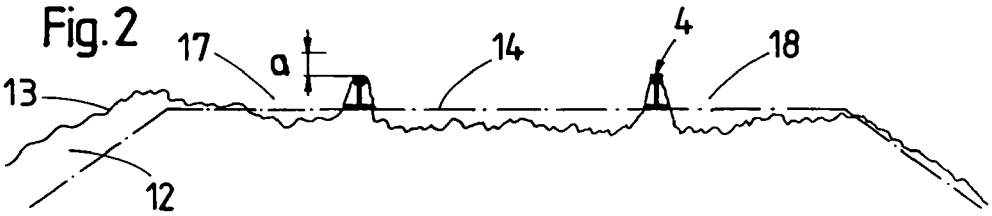
FIG. 2 illustrates a recorded actual track bed profile and a stored desired track bed profile determining the desired track level.

The track bed profile scanning is effected at distances of two meters, scanned track bed profile 13 being graphically illustrated according to FIG. 2, and desired track level 14 being blended in, or superimposed on, the recorded scanned track bed profile. The desired track level is selected at the beginning of the operation, according to the prevailing condition of the track.

As shown in FIG. 3, the amount of required ballast is calculated and the calculation is stored separately for a left and a right half of the track bed. Bar diagram 15 is produced simultaneously with scanned track bed profile 13, a green bar (shown in full lines) indicating an excess of ballast at the scanned location and a red bar (shown in broken lines)

indicating a ballast deficit. The height of each bar shows the magnitude of the volume difference between scanned track bed profile 13 and desired track bed lever 14. In bar diagram 15 shown in FIG. 3, a clear ballast excess is present at that location in left half 17 of the track bed (above center line 16 of track 4) while right track half 18 (below track center lined 16) shows little ballast deficit and excess.

The diagram of FIG. 4 shows the differences of the ballast volume along the scanned track section. This enables the requirement of ballast in tons/meter to be determined exactly for a given track section, the diagram of FIG. 3 illustrating the respective ballast requirements for each track half 17, 18. In this way, the accurately determined amounts of ballast may be supplied for tamping, and the necessary movements of a ballast plow used to guide the supplied ballast are reduced to a minimum. Any excess ballast is removed from the track bed, temporarily stored and then supplied to track sections requiring it.

The combination of a track position measurement with recording the ballast distribution determining the track bed profile has the great advantage of assuring an optimal distribution of the ballast, without requiring any additional manipulative steps. In addition to the savings achieved, this has the additional advantage that uniform distribution of the ballast can be obtained for a track whose position has been corrected without causing unnecessary movements of large amounts of ballast.

Instead of using a track survey car for scanning the track bed profile, this could be done with a ballast tamping machine.

What is claimed is:

1. A method for the contactless scanning of a track bed profile extending perpendicularly to a longitudinal extension of the track, comprising the steps of (a) simultaneously effectuating the scanning and a measurement of any deviation from a desired track level at a location of the scanning, (b) recording the scanned track bed profile, and (c) calculating an amount of ballast required for subsequently raising the track to the desired track level at said location and for uniformly distributing the ballast in the track bed in dependence on the measured track level deviation and the recorded scanned track bed profile.

2. The method of claim 1, wherein a desired transverse track bed profile is superimposed on the recorded scanned track bed profile when calculating the amount of ballast required.

3. The method of claim 1, wherein the amount of required ballast is calculated and the calculation is stored separately for a left and a right half of the track bed.

* * * * *